United States Patent [19]

Smith

[11] 3,936,854

[45] Feb. 3, 1976

[54] APPARATUS FOR DEVELOPING PHOTOSENSITIVE MATERIAL

[75] Inventor: David S. Smith, Pittsford, N.Y.

[73] Assignee: Eastman Kodak Company, Rochester, N.Y.

[22] Filed: May 24, 1974

[21] Appl. No.: 473,034

[52] U.S. Cl. ..... 354/299; 354/323; 355/10

[51] Int. Cl.[2] ..... G03D 13/00; G03D 3/08

[58] Field of Search ..... 355/10; 354/297, 299, 300, 354/317, 323, 324, 326

[56] References Cited

UNITED STATES PATENTS

| | | | |
|---|---|---|---|
| 2,476,007 | 7/1949 | Tuttle et al. | 354/317 X |
| 2,631,511 | 3/1953 | Tuttle | 354/317 X |
| 2,922,353 | 1/1960 | Berley | 354/317 |
| 3,060,829 | 10/1962 | Leighton et al. | 354/299 |
| 3,081,687 | 3/1963 | Takats | 354/317 |
| 3,149,550 | 9/1964 | Lohse et al. | 354/323 X |
| 3,619,053 | 11/1971 | Mannik | 355/10 X |
| 3,744,394 | 7/1973 | Firth | 354/317 X |

*Primary Examiner*—Fred L. Braun
*Attorney, Agent, or Firm*—J. D. Husser

[57] ABSTRACT

An apparatus for the liquid processing or development of a latent image on a photographic or electrostatic material utilizes a single liquid, usually referred to as a monobath, for developing the latent photographic image or a liquid developer, which comprises a liquid carrier and toner particles, for developing the latent electrostatic image.

The apparatus comprises two members between which the material is clamped during the development process. The first member which is fixed, has an open-end chamber that is interconnected to two sources of air under pressure and to a reservoir for at least one processing fluid. This chamber is also provided with two concentrically arranged sealing means for retaining the processing fluid in proper relation to the image area being developed when the material is clamped between the two members. The second member also has an open-end chamber which is enclosed by a transparent support and is movable relative to the first member for clamping the material therebetween via the sealing means. After the processing fluid has been introduced for developing the latent image, two air flows of different duration are then introduced into the chamber of the first member. The one flow of air removes and squeegies any remaining fluid within the confines of the inner sealing means off the surface of the material and carries it away in a mist or in a finely atomized condition. The other flow, which is of shorter duration, breaks the inner sealing means in order to remove any residual fluid that may have accumulated at its sealing position relative to the material. The apparatus is therefore intended primarily for a cycle of operation with respect to a strip or sheet of material that is moved intermittently rather than continuously relative to the apparatus.

5 Claims, 9 Drawing Figures

FIG. 1
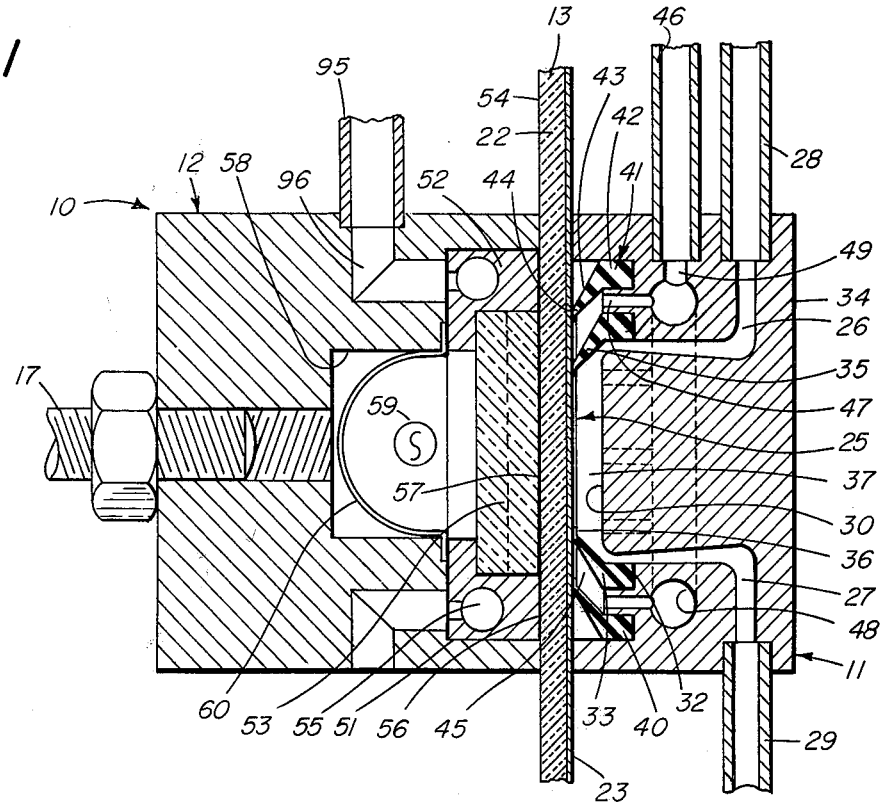
FIG. 2
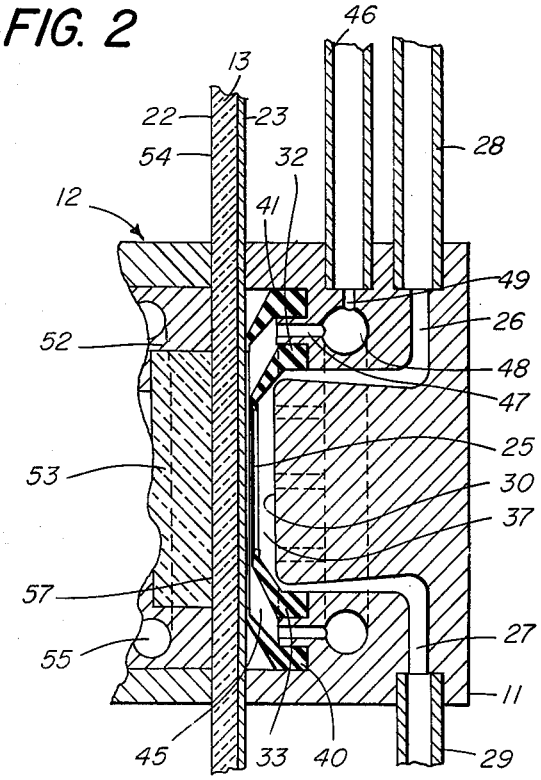
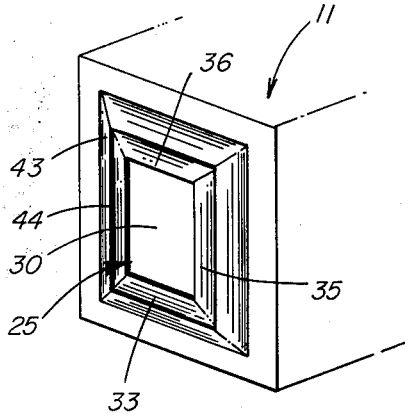
FIG. 3

FIG. 4
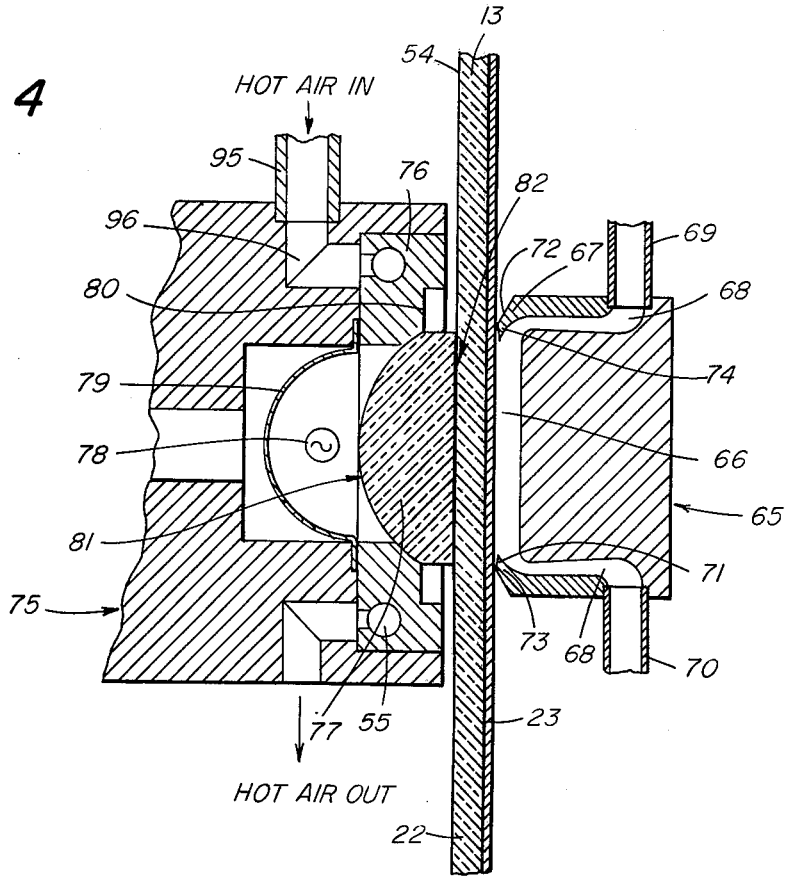
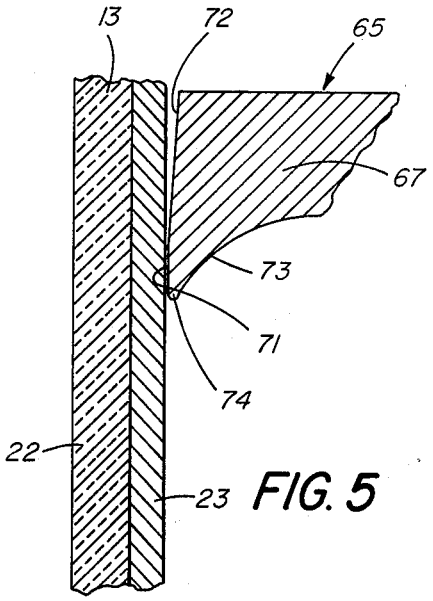
FIG. 5
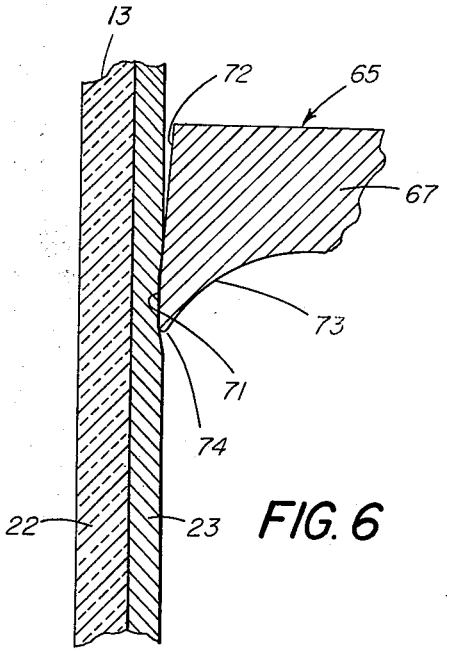
FIG. 6

APPARATUS FOR DEVELOPING PHOTOSENSITIVE MATERIAL

FIELD OF THE INVENTION

This invention relates to apparatus for the development of a latent electrostatic or photographic image and, more particularly, to an apparatus or device for the liquid development of the discrete latent images arranged in adjacent relation on a photosensitive support or film.

DESCRIPTION OF THE PRIOR ART

It is well known to apply a liquid composition to a surface of a photosensitive material for developing the latent image thereon. Such a latent image can be one formed on a photosensitive material of the electrostatic or photographic type. In either case, the latent image is developed by applying the developing liquid or liquids to the surface bearing the latent image. In various types of apparatus known in the prior art, the image-wise exposed material is clamped in position relative to a processing or developing head and a single or a number of liquids are then applied sequentially to the surface bearing the latent image. Such processing or developing of a latent image can also include in its cycle of operation, the application to the image area of air for drying the previously applied fluid, or a liquid which will displace the processing solutions because of its repellent characteristics.

In many of the developing devices disclosed in the prior art, an attempt is made to use a minimum amount of processing solution. Accordingly, the spacing between the surface bearing the latent image and the facing surface of the device is of a very small dimension. With such a small space adjacent the image-bearing surface, it is not always possible to obtain a maximum or optimum development of the latent image because the strength of the processing or developing liquid is diluted as it moves across the image area. In addition, because of the small amount of processing liquid that might be used, the processing device per se is designed so that there is very little, if any, need to seal the adjoining image areas from that being developed or processed. Another need that becomes necessary with the utilization of a very small space between the image-bearing surface and that of the device facing this surface is the requirement that the area of material being developed be maintained as flat as possible in order that the processing liquids can pass thereover in a relatively thin and even film. Hence, it is required that the area of material be held against a backing plate, preferably by means of a vacuum, whether the processing is one for photographic material or for electrostatic material.

SUMMARY OF THE INVENTION

One object of the invention is to provide apparatus for the liquid processing of an electrostatic or photographic material having successive images on a strip of such material, each of the images being individually and successively processed with an identical processing cycle.

Another object of the invention is to provide apparatus for the liquid processing of an electrostatic or photographic material having a latent image to be developed in which the image area is surrounded at its peripheral edge with a seal that contains the processing liquid which is applied to the image area under differential pressure.

Still another object of the invention is to provide apparatus for the liquid processing of an electrostatic or photographic latent image in which the seal surrounding the image area can be made more efficient with an increase in pressure, thereby limiting the size of the meniscus of liquid at the seal.

Yet another object of the invention is to provide apparatus for the liquid processing of an electrostatic or photographic latent image in which the image area is enclosed with a double seal which permits the removal of any liquid with air under pressure by deflecting or incapacitating the inner seal during at least a part of the drying portion of the processing cycle.

These and other objects and advantages of the invention will be apparent to those skilled in the art by the description of the apparatus which is set forth in detail hereinafter.

The above objects and advantages are attained by an apparatus for the liquid processing or development of a latent image on an electrostatic or photographic material. A single liquid, usually referred to as a monobath, can be used to develop the latent image on a photographic material, whereas a liquid developer which comprises a liquid carrier and toner particles can be used to develop a latent electrostatic image. On the other hand, developer and fixer solutions, as well as water, or various processing gases can be introduced sequentially into the apparatus to develop a photographic latent image in a well known manner. The terms "process," "develop," "processing," "developing," etc., are therefor considered to be synonomous as used throughout the specification and claims. In the same manner, "photosensitive material" is meant to include electrostatic as well as photographic material in either the transparent (e.g. film) or opaque (e.g. paper) form. The term "processing fluid" is meant to include liquid or gaseous processing materials, as well as air which is used as a drying medium.

The apparatus comprises a first member having an open-end chamber that is interconnected to a reservoir for at least one processing fluid and is provided with sealing means for retaining the processing liquid in proper relation to the image area being developed. The sealing means comprises at least one peripheral member that engages the latent image-bearing surface when the material is arranged in the processing apparatus. A second member having an open-end chamber and a transparent support which encloses the open end is movable relative to the first member for clamping the photosensitive material therebetween via the sealing means. Suitable means is interconnected to the second member for moving the latter into a material clamping position relative to the first member. In one embodiment, a sealing means comprises at least one extending lip having a cross section including an arcuate portion that intersects a planar surface for engaging and compressing the photosensitive material immediately adjacent the image area, the profile being such as to limit the meniscus of processing fluid at the intersection. The sealing means in another embodiment can comprise a pair of similar, flexible, extending lips arranged in spaced relation one within the other for engaging the material adjacent the image area. In this latter arrangement, the first member is provided with suitable ducts so the processing liquid is directed as a flow over the material or, more specifically, over the image area and within the confines of the inner lip. After the processing liquid has been applied for developing the latent image, air under pressure can be directed into the chamber between the confines of the pair of lips surrounding the image area. When the air is so applied, the effective seal of the outer lip with respect to the material is increased in that it is urged into more intimate contact with the surface of the material and, at the same time, the inner lip is disengaged from the material, whereby the flow of air moves over the entire image area and discharges through the duct or ducts through which the processing liquid had been previously introduced. The application of air under pressure removes any residual liquid that may have accumulated at the edge of the extending lip or the inner sealing lip. When the resilient lips are utilized, such residual processing liquid is completely removed and, in effect, the air also squeegies any remaining liquid off the surface of the material and carries it away through the ducts in a mist or in a finely atomized condition. The apparatus is therefore intended primarily for a cycle of operation with respect to a strip or sheet of material having at least one latent image thereon and that can be moved intermittently rather than continuously relative to the apparatus.

DESCRIPTION OF THE DRAWINGS

FIG. 1 is a vertical section through the apparatus comprising the invention showing the pair of flexible lips forming the sealing means and the relation of such lips to the latent image area on the photosensitive material being processed;

FIG. 2 is a vertical section through the apparatus and is similar to FIG. 1 showing particularly the position assumed by the inner sealing lip when air under pressure is applied to the apparatus;

FIG. 3 is a perspective view showing particularly the bottom surface of the first member and the concentric sealing lips;

FIG. 4 is a vertical section through the apparatus and is similar to FIG. 1 showing a single sealing lip for retaining the processing liquid and the relation of such lip to the photosensitive material;

FIGS. 5 and 6 are enlarged detailed views of the sealing means shown in FIG. 4 showing the manner in which the lip compresses the photosensitive material to provide an effective operative seal for the processing liquid;

DESCRIPTION OF THE PREFERRED EMBODIMENT

Figure 7:
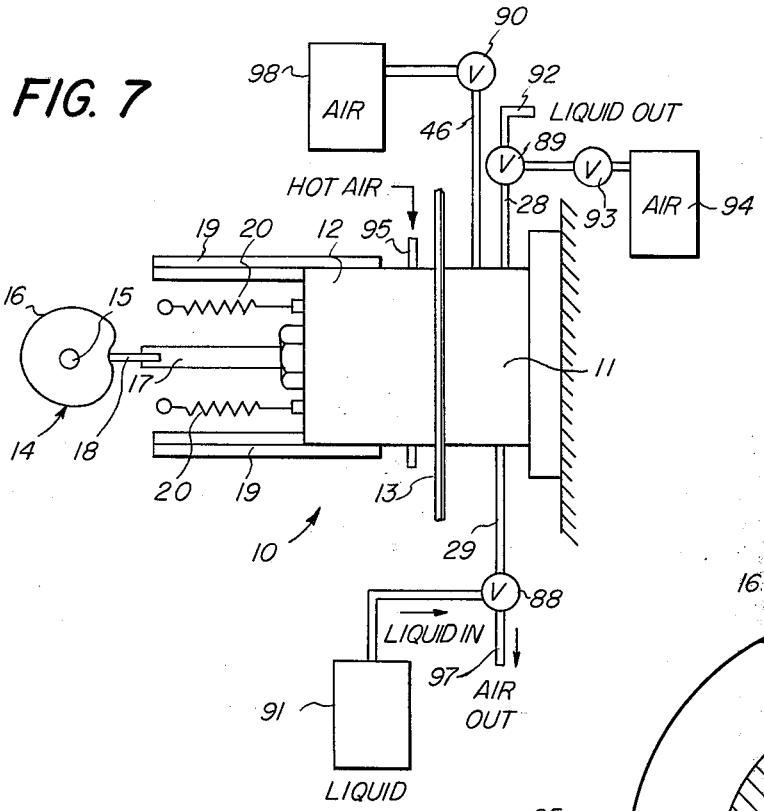
FIG. 7 is a schematic view showing the manner in which the members of the apparatus are moved relative to one another during the cycle of operation.

With particular reference to FIGS. 1 and 7, the processing apparatus, designated generally by the numeral 10, comprises a fixed member 11 and a movable member 12, the latter being actuated into a position to clamp the photosensitive material 13 between the members 11 and 12 by a cam-actuated mechanism designated generally by the numeral 14. The cam mechanism 14, see FIG. 8A, comprises a shaft 15 which carries a cam 16, the shaft being driven by a suitable motor drive not shown. The member 12 carries a rod 17 which has a follower 18 for engaging the peripheral surface of the cam 16. The member 12 is mounted in suitable guides 19 and the follower 18 is maintained in contact with cam 16 by suitable resilient means, such as springs 20. Since the member 11 is fixed, the member 12 is normally urged toward the shaft 15 by the springs 20, so that movement of the member 12 into a position for clamping material 13 is contrary to the force exerted on this same member by the springs 20. Hence, the movement of member 12 is maintained in one direction by the cam 16 and by the springs 20 in the opposite direction.

The photosensitive material 13 comprises a transparent support 22 and a light-responsive layer 23 which can be a photoconductive or an emulsion layer. The layer 23 has been exposed to provide a plurality of latent images which are arranged successively in the longitudinal direction of a strip or in an X-Y format on a sheet. Such an exposed material can be processed in a well known manner with a liquid developer, such as toner for an electrostatic image or a monobath or a developer solution, a hypo solution, and finally washing with water for a photographic image. From the description which follows it will be evident to those skilled in the art that the apparatus disclosed herein would not be satisfactory for processing a web of material that is moved continuously through the processing apparatus. Rather, the processing apparatus disclosed herein is one in which the individual latent image areas are successively processed or developed with intermittent movement of the material. At this point, it should be recognized that while the disclosure of the invention is made with respect to processing of a latent electrostatic image, the same could be used in processing a latent photographic image with the conventional liquid developers known and used in this art. Again, the actual process or development would be on the basis of individual image areas and with intermittent movement of the material.

The fixed member 11 can comprise a number of elements so formed and assembled as to provide a processing head to fulfill the conditions and mode of operation set forth hereinafter. More specifically, the member 11 is provided with an open end 25 which forms a number of chambers as described hereinafter. The open end 25 is connected by suitable ducts 26 and 27 to entry and discharge conduits 28 and 29, respectively. From FIG. 1 it will be noted that the ducts 26 and 27 terminate in the open end 25. However, the surface 30 is spaced from the surface 31 of the member 11 which contacts the image-bearing surface layer 23 of the material 13 in the clamping position. The member 11 is provided with a recess 32 which surrounds the surface 30 and into which a resilient sealing member 33 is arranged. The cross section of sealing member 33 is generally as shown in FIG. 1 and can have any predetermined peripheral shape which conforms generally to that of the image area; that is, the sealing member 33 can be square, rectangular, circular or any other shape in accordance with the shape of the image area that is to be processed, see FIG. 3. The sealing member 33 comprises a mounting portion 34 having an extension 35 that terminates in a lip 36 which engages the peripheral edge of the image area. The lip 36 also serves to engage the surface of the layer 23 so the sealing member 33, effectively, forms with the surface 30 of member 11, a chamber 37 into which the processing liquid can be introduced in a manner to be described hereinafter.

The member 11 is also provided with a second recess 40 for retaining a second resilient sealing member 41 which is substantially of the same cross section as the sealing member 33 but somewhat larger in size, see FIG. 3. The sealing member 41 also comprises a mounting portion 42 having an extension 43 and a lip 44 which also contacts the surface of the layer 23. It will be noted that since the sealing members 33 and 41 are arranged one within the other, a second chamber 45 is formed by these two members. The chamber 45 is interconnected to a conduit 46 by a plurality of ducts 47 that intersect a passageway 48 that is formed in the member 11 and interconnected to the conduit 46 via the opening 49.

With reference to FIG. 1, the member 12 has secured thereto the rod or extension 17 which engages the cam 16 via the follower 18. The member 12 is provided with a recess 51 in which a heater member 52 and a transparent plate 53 are mounted and each of which engages the facing surface 54 of the support 22. The heater member 52 is provided with a duct 55 through which hot air can be circulated or in which a heating element or coil can be arranged. The heat transferred to the member 52 is conducted to the support 22 by the portion 56 in contact therewith and also to the transparent plate 53, the surface 57 of which also engages surface 54 of the support 22. Immediately below the recess 51 for the heater member 52 is a smaller recess 58 in which a flashlamp 59 is arranged between a reflector 60 and the transparent plate 53. At this time, it should be pointed out that the relative positions of the members 11 and 12 and of the material 13 are generally as shown in FIG. 1; that is, the material 13 is maintained in a generally vertical plane so that in one direction the force of gravity can be utilized to assist the required displacement of fluid.

With respect to FIG. 4, another embodiment of the invention is shown in which a fixed member 65 is provided with an open-end chamber 66 that is provided with an extending peripheral lip 67. The chamber 66 is interconnected by a number of ducts 68 to conduits 69 and 70. The lip 67 conforms generally in its inner peripheral dimensions to that of the latent image area on the material 13. With reference to FIGS. 5 and 6, it will be noted that the lip 67 is formed with a particular cross-sectional shape in order to provide a maximum seal with respect to the layer 23. The lip 67 is formed with an engaging surface 71 and a rearward extending relief surface 72. The internal portion of the lip, as indicated at 73, is curved to provide means for directing a smooth flow of liquid or air into the chamber 66 and over the image surface. It will be noted that the intersection or junction of the surfaces 71 and 73 provides a relatively sharp nose 74 that effectively limits the size of the processing fluid meniscus. As a result, the flow of air or processing fluid is such that a minimum of turbulence is obtained and with the air flow any liquid that might accumulate at the junction of the nose 74 with the layer 23 is effectively removed. With particular reference to FIG. 6, it will be noted that the surface 71 tends to compress the layer 23, as well as layer 22 immediately thereunder, at the marginal portion of the layer immediately surrounding the image area, thereby obtaining a maximum seal for both processing fluid and air.

A movable member 75 is also associated with the fixed member 65 and comprises a heater member 76 similar to member 52, a transparent member 77, a flashlamp 78 and a reflector 79. In this embodiment, the heater member 76 is provided with a spherical seat 80 which conforms to the spherical surface 81 of the transparent member 77. In this particular case, the size of the transparent member 77 must be larger than the image area being developed. It will be readily understood that with surface 81 and the fact that the transparent member 77 merely rests on the spherical surface 80, the transparent member 77 can be moved or tilted so as to compensate for any pressure inequality that might be exerted by the lip 67 against the material 13. In other words, the transparent member 77 is free to rock and to adjust so that the pressure exerted by the surface 71 of the lip 67 is generally uniform around the peripheral area of the image area, thereby providing a complete and maximum seal when the surface 82 is brought into contact with surface 54.

As pointed out hereinabove, the processing apparatus can be utilized for the processing or developing of either an electrostatic or photographic latent image. However, the apparatus that has been described is used primarily for the development of an electrostatic image. Normally, the apparatus is associated with peripheral apparatus which provides the plurality of exposed areas on the material 13. These latent images are arranged in successive areas on a strip of material or in an X-Y direction on a sheet of material. In either case, the image area is separated from the adjacent area or areas, so as to provide a peripheral area in which the sealing means can engage the material without endangering or injuring any part of the latent image area per se. Consequently, the strip or sheet of material is positioned relative to the fixed or movable member 11 or 12 and the movable member 12 is then moved into a position in which the image area is surrounded by the lips 36, 44 or the lip 67 and clamped in a sealed relationship.

Figure 8A:
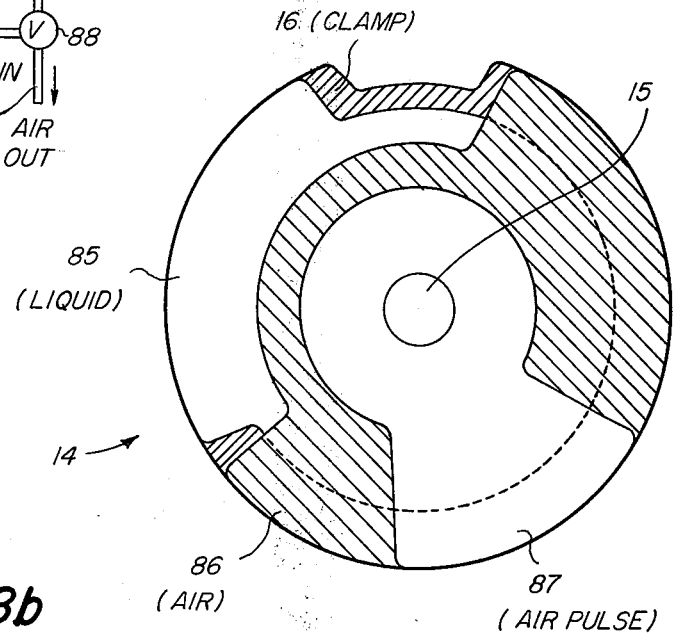
FIGS. 8A and 8B are a schematic view of a plurality of cams and of a related timing chart for the cams, respectively, to provide a processing cycle of operation.
Figure 8B:
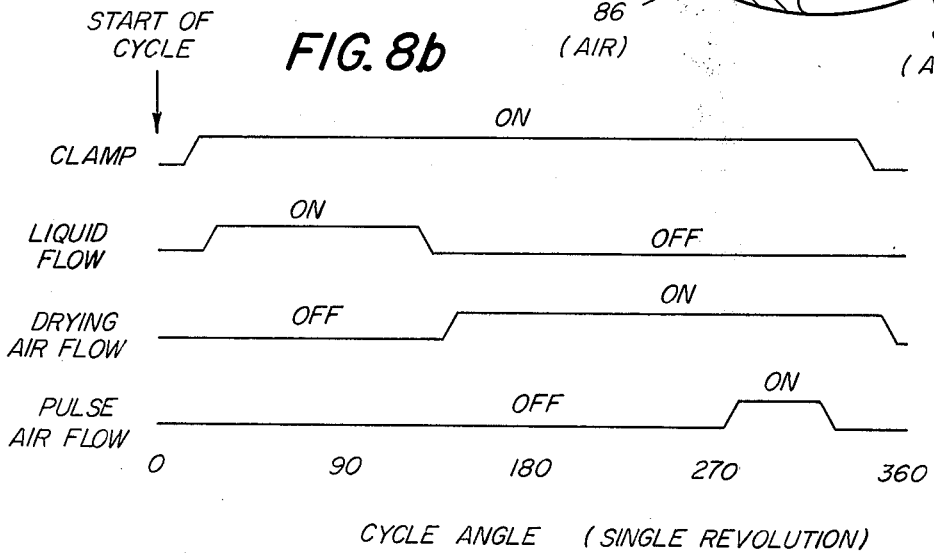

With reference to FIGS. 8A and 8B, there is disclosed means for controlling a cycle of operation with respect to and for the invention described hereinabove. The cam mechanism 14 comprises additional cams 85, 86 and 87 which are mounted with cam 16 on shaft 15. The cams are angularly oriented in accordance with the timing chart shown in FIG. 8B. As described above, cam 16 controls the clamping of the material 13 between the fixed and movable members 11 and 12 or 65 and 75. Cams 85, 86 and 87 are associated, respectively, with control of the period of liquid flow, of air flow and of air pulse. This control can be through the medium of actuating respective micro switches associated with appropriate circuitry for controlling valves 88 and 89 which are two-way valves and valve 90. As will be apparent from the description which follows, cam 87 and valve 90 are not used with the embodiment disclosed in FIG. 4.

With respect to the embodiments shown in FIGS. 1 and 4, the material 13 is positioned between the movable and fixed members 11, 12 or 65, 75 with the image aligned with the lips 36, 44 or 67. Hot air is continuously supplied via conduit 95 and duct 96 to duct 55. The heat transferred to heater member 52 or 76 is conducted to support 22 and layer 23 via surface 57 or 82 which is in contact with surface 54 when material 13 is clamped between surface 57 or 82 and the lips 36, 44 or 67. After the material 13 has been clamped with the image area properly oriented, the processing procedure is then commenced.

With particular reference to the embodiment shown in FIG. 1, cam 85 will open valves 88 and 89 via appropriate circuitry not shown, thereby permitting the processing liquid to move from a suitable reservoir 91 through the valve 88 and to the apparatus via conduit 29 or 70. The liquid is introduced at a controlled velocity to limit turbulence at the surface of the layer 23. The liquid rises vertically in the chamber 37 and forces ahead of it any air or other gas that might be in the chamber and ducts. The liquid moves through the duct 26, the conduit 28, the valve 89 and into discharge conduit 92. As a result, the liquid moves over the image area in a direction that is generally the reverse of that found in the prior art. It is conceivable that a first liquid can be introduced into the chamber 37 for the purpose of conditioning the image surface in preparation for the processing liquid that follows. After the image has been developed by the movement of the processing liquid over the image surface, as determined by cam 85, the liquid is then cut off and valves 88 and 89 return to their normal state. At this point, cam 86 actuates valve 93 to an open position by means of appropriate circuitry, thereby permitting air under pressure from source 94 to be introduced into the conduit 28. The air flows over the image surface that was developed in a direction opposite to that of the flow of the processing liquid; namely, in a downward vertical direction. At the same time, any excess liquid that may have adhered to the image area or any of the surfaces within the member 11 will be removed by the air via duct 27 and exhausted via conduit 29, valve 88 and conduit 97. If air, or another gas under pressure, is not used, a vacuum can be applied via conduit 97, valve 88 and conduit 29 to effect the same result so that the flow of any liquid within the member 11 will still be in the same downward direction. With either the air, gas under pressure, or a vacuum, the flow is in a downward direction over the film surface, as shown in FIGS. 1 and 4 and will dry the developed image area. The heat supplied by member 52 is conducted through plate 53 to material 13 and serves to not only maintain the liquid at its required temperature but also to facilitate the drying operation.

While the drying process is continuing, cam 87 causes valve 90 to be actuated to an open position at a relative time as shown in FIG. 8B. Air under pressure from a source 98 is then introduced via conduit 46 into the chamber 45 formed by the sealing members 33 and 41. With the introduction of such air under pressure, the member 33 is moved so its lip 36 is raised or lifted from the surface of the material, see FIG. 2. The flow of air will then dislodge any residual liquid that may be trapped or held by virtue of the lip 36 being in contact with the material. A pressure differential between the chamber 37 and chamber 45 is necessary in order to force the lip 36 away from the surface of layer 23. Such a pressure differential also acts as an air knife and eliminates the making of edge markings on the image that are prevalent in similar types of processing apparatus.

The air that is introduced via duct 46 is preferably warmed in order to provide a maximum drying effect and at the same time the heating member 52 continues to supply heat to the transparent plate 53. As a result, the application of heat to both sides of the material aids in drying the developed image surface in a shorter period of time. Just prior to completion of the drying operation, the flash tube 59 is triggered and the energy from the flash plasma passes through the transparent plate 53 and the support 22 to the image area in layer 23. This additional heat tends to further set or harden the image on the surface of the material, which is usually required of a toner developed electrostatic image. At the conclusion of the cycle, the member 12 is withdrawn and the material 13 is then advanced or moved to position another image area relative to the sealing members 33 and 41.

A cycle of operation, with respect to the embodiment disclosed in FIG. 4, is substantially the same as that with respect to the embodiment shown in FIG. 1. The exception, of course, is the application of the air or gas to the chamber 45 which is lacking in the embodiment shown in FIG. 4. Aside from this difference, the cycle is substantially the same. With the application of warm air to the layer 23, the heating member 76 also conducts heat to the material 13 through the transparent member 77 which is also in conducting relation with the support 22. Also, the triggering of the flash tube 78 occurs in the same way and at the same relative time as described above with respect to FIG. 1.

The ducts or flow passages 26, 27 and 68 are generally shaped as shown in FIGS. 1, 2 and 3 to reduce and control the liquid and air flow velocity, pattern and turbulence upon introduction into the chamber 37 or 66. With such control it is also possible to prevent flow streaks on the developed image. While materials other than metal might be used for the members 11, 12 or 65, 75 metal is considered to be preferable inasmuch as it offers rigidity as well as good heat conductivity. Colorless, commercial sapphire is considered to be a preferred material for the transparent plate member 53 or 77 because of its relatively good thermal conductivity and its broad spectral transmission characteristics. However, in some instances it may be desirable that the plate member 53 or 77 be opaque rather than transparent, in which case any material having high thermal conductivity properties can be used.

The invention has been described in detail with particular reference to preferred embodiments thereof but it will be understood that variations and modifications can be effected within the spirit and scope of the invention.

I claim:

1. In apparatus for the fluid processing of a photosensitive material comprising a support and at least one photosensitive layer bearing a latent image area of a predetermined size and shape, the combination comprising:

a first member having an open-end chamber of a size and shape larger than the latent image area, at least one duct having an entry into the open-end chamber outwardly of an area of the open-end chamber generally equivalent to that of the latent image area for interconnecting the open-end chamber to a first source of air under pressure, at least one inlet and at least one outlet interconnecting the open-end chamber within the area to a second source of air under pressure and to at least one source of processing fluid;

sealing means arranged within the open-end chamber comprising a pair of similar flexible, extending members arranged in spaced and coaxial relation with one another, the outermost member being of a size larger than the latent image area and arranged outwardly of the duct entry for engaging the photosensitive layer when the material is arranged with respect thereto, and the innermost member being of a size for engaging the photosensitive layer immediately adjacent the latent image area and arranged between the duct entry and the inlet and the outlet for confining the processing fluid to the latent image area;

a second member movable relative to the first member for clamping the material therebetween with the latent image area generally aligned with the sealing means;

means interconnected to the second member for moving the latter into a material clamping position relative to the first member; and control means associated with the, first and second sources of air and with the source of processing fluids and operable when the first and second members are in the material clamping position, for introducing a flow of the processing fluid and a first flow of air from the second source through the open-end chamber and over the latent image area within the confines of the innermost member, and a second flow of air from the first source between the outermost and innermost members to increase the effective seal of the outermost member with the material and at the same time to disengage the innermost member from the material, whereby the second flow of air removes any accumulation of the processing fluid at the effective seal of the innermost member.

2. The apparatus in accordance with claim 1 wherein the processing fluid comprises a flow of at least one liquid developer and the first and second flows of air are in a direction opposite to that of the flow of the developer.

3. The apparatus in accordance with claim 2 wherein the control means cycles the first and second flows of air subsequent to the flow of the liquid developer, the flows of air being in the same direction with the second flow of air being of shorter duration than that of the first flow of air and introduced during the time of the first flow of air.

4. The apparatus in accordance with claim 1 wherein the second member is provided with an open-end chamber enclosed by a transparent support and including means associated with the second member for continuously heating the same and the transparent support, whereby heat is conducted by the transparent support to the material when the latter is clamped between the first and second members.

5. The apparatus in accordance with claim 4 including means arranged within the open-end chamber of the second member and responsive to the control means for initiating a second source of heat for the transparent support that augments the first-mentioned heating means for fixing and/or drying the developed image.

* * * * *